US007028697B2

(12) United States Patent
Christman et al.

(10) Patent No.: US 7,028,697 B2
(45) **Date of Patent: *Apr. 18, 2006**

(54) IN-SINK DISHWASHER

(75) Inventors: Ralph E. Christman, St. Joseph, MI (US); Ryan K. Roth, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/138,368

(22) Filed: May 3, 2002

(65) Prior Publication Data

US 2003/0205246 A1 Nov. 6, 2003

(51) Int. Cl.
*B08B 3/02* (2006.01)

(52) U.S. Cl. ..... 134/115 R; 134/95.1; 134/95.3; 134/103.1; 134/103.2; 134/103.3; 134/176; 134/179; 134/198

(58) Field of Classification Search ..... 134/95.1, 134/95.3, 103.1, 103.2, 103.3, 176, 179, 134/198, 115 R
See application file for complete search history.

(56) References Cited

U.S. PATENT DOCUMENTS

| | | | | |
|---|---|---|---|---|
| 2,418,366 | A | 4/1947 | Powers | 134/57 |
| 2,575,704 | A | 11/1951 | Clark | 134/58 |
| 2,579,393 | A | 12/1951 | Modrey | 4/187 |
| 2,618,282 | A | 11/1952 | Stanitz et al. | 134/58 |
| 2,632,452 | A | 3/1953 | Spitzer | 134/115 |
| 2,692,602 | A | 10/1954 | Stanitz et al. | 134/57 |
| 2,713,345 | A | 7/1955 | Stanitz et al. | 134/55 |
| 2,745,417 | A | 5/1956 | Fielding | 134/58 |
| 2,759,485 | A | 8/1956 | Guth | 134/58 |
| 3,358,702 | A | 12/1967 | Schaap | 134/58 |
| 3,709,236 | A | 1/1973 | Field et al. | 134/104 |
| 3,863,657 | A | 2/1975 | Irving | 134/57 |
| 4,334,143 | A * | 6/1982 | Cushing | 392/441 |
| 4,919,162 | A | 4/1990 | Lumby et al. | 134/115 |
| 4,951,693 | A | 8/1990 | Archambault | 134/57 |
| 5,178,172 | A | 1/1993 | Morley | 134/183 |
| 5,193,562 | A | 3/1993 | Rigby et al. | 134/57 |

(Continued)

FOREIGN PATENT DOCUMENTS

| | | |
|---|---|---|
| DE | 3922754 | 1/1992 |

(Continued)

OTHER PUBLICATIONS

Patent Abstracts of Japan, Publication No. 10-225330, Date of Publication Aug. 25, 1998.

(Continued)

*Primary Examiner*—Zeinab El-Arini
(74) *Attorney, Agent, or Firm*—Clifton G. Green; Robert O. Rice; John F. Colligan

(57) ABSTRACT

A dish-cleaning appliance comprising a sink having a bowl defining a wash chamber with an open top for providing access to the wash chamber. A liquid recirculation system is provided for spraying liquid throughout the wash chamber. A drain conduit can be provided, alone or in combination with the recirculation system, for draining liquid from the wash chamber when the drain is closed. A fill control system is provided to ensure that the dishwashing cycle is not started with liquid in the wash chamber and that the sink drain is properly closed. One or more sensors can be provided for enabling the fill control system. The sensors can be located within the drain above the location where the drain is plugged.

32 Claims, 10 Drawing Sheets

U.S. PATENT DOCUMENTS

| | | | | |
|---|---|---|---|---|
| 5,881,746 | A | 3/1999 | Buser et al. | 134/58 |
| 5,900,070 | A * | 5/1999 | Jarvis et al. | 134/18 |
| 5,934,298 | A | 8/1999 | Singh | 134/85 |
| 6,742,531 | B1 * | 6/2004 | Christman et al. | 134/115 R |

FOREIGN PATENT DOCUMENTS

| | | | |
|---|---|---|---|
| DE | 4420775 | 8/1995 | |
| GB | 929348 | 10/1960 | 138/1 |
| JP | 1022531 | 8/1998 | |

OTHER PUBLICATIONS

Patent Abstracts of Japan, Publication No. 10-028667, Date of Publication Mar. 2, 1998.

Patent Abstracts of Japan, Publication No. 2001-087198 Date of Publication Mar. 4, 2001.

* cited by examiner

IN-SINK DISHWASHER

BACKGROUND OF THE INVENTION

1. Field of the Invention

The invention relates to an in-sink dishwasher for automatically washing household dishes without requiring the physical space of a built-in automatic dishwasher. In one aspect, the invention relates to a method for controlling the liquid filling operations of the in-sink dishwasher and preventing the normal sink usage from interfering with the dishwasher usage. In another aspect, the invention relates to a drain structure that permits the draining of the liquid while the drain is plugged. In a further aspect the invention relates to the dishwasher having a user interface mounted within the sink and which is covered by the lid when the lid is closed.

2. Description of the Related Art

In-sink dishwashers use the bowl of a sink to form part of the dishwasher housing that defines a wash chamber, with the open top of the bowl providing access thereto. A liquid recirculation system sprays wash liquid throughout the wash chamber to clean any dishes placed within. A lid covers the open top of the bowl when the in-sink dishwasher is being used to prevent the splashing or spraying of the recirculating wash liquid out of the open top of the bowl.

The liquid recirculation system normally operates based on the assumptions that the wash chamber is not filled with liquid and a known volume of liquid is recirculated through the wash chamber. If liquid is present in the wash chamber prior to the initiation of the wash cycle, the liquid can interfere with the direct spraying of liquid on the dishes, reducing the cleaning performance or causing an overflow of the wash chamber.

In the in-sink dishwasher environment, the dual use of the sink as a sink and as the wash chamber for the dishwasher creates the possibility that the user may partially or wholly fill the sink with liquid prior to the initiation of the wash cycle, which can lead to an overfill and possible overflow condition. Alternatively, the user may leave out the sink drain plug which would prevent the retention of the wash liquid within the wash chamber, resulting in the loss of the ability to recirculate the wash liquid. It is highly desirable to have a method for controlling an in-sink dishwasher such that the fill control system monitors for the condition wherein the wash chamber is partially or wholly filled with liquid or the sink drain has not been properly closed.

The use of a plug to close off the drain during the use of the sink during dish washing operations also raises unique problems since most dish washing cycles require the introduction and draining of multiple charges of liquid, yet the sink drain must be closed to permit recirculation of the wash liquid. The sink drain cannot be left open during the dish washing cycles. Thus, the in-sink dishwasher must provide a way to drain the sink while the sink drain is plugged.

SUMMARY OF THE INVENTION

The invention relates to that method for operating an in-sink washer comprising the sink having a bowl forming a wash chamber and a liquid recirculation system for spraying liquid throughout the wash chamber to wash any dishes therein. The method comprises determining the level of liquid in the bowl prior to the initiation of a wash cycle and operating the wash cycle based on the determined liquid level.

The method can further comprise the draining of liquid from the bowl if the liquid level is greater than a first predetermined level. The draining step can comprise draining liquid from the bowl for a first predetermined time. Upon the completion of the predetermined time, the wash cycle can be initiated regardless of the current liquid level.

Alternatively, the draining step can comprise draining the liquid from the bowls until the liquid level is below a first predetermined level. The method can include suspending or terminating the wash cycle if the liquid level remains above the first predetermined level after completion of the draining step. An alarm can be triggered if the liquid level remains above the first predetermined level after completion of the draining step. Suitable alarms would include one or both of an audio or visual alarm.

It is preferred that the wash cycle be automatically initiated if the liquid level is below the first predetermined level. The wash cycle comprises filling the wash chamber with the liquid to a second predetermined level. The liquid can then be recirculated by the recirculation system throughout the wash chamber to clean the dishes.

The wash cycle can be suspended or terminated if the liquid level does not reach the second predetermined level within a predetermined time period. The liquid pressure of the liquid in the wash chamber can be monitored during the filling step to determine when the liquid level has reached the second predetermined level.

In another aspect, the invention relates to a method comprising filling the bowl with liquid to a predetermined level, monitoring the liquid level in the bowl during filling, and recirculating the liquid throughout the wash chamber if the liquid level reaches the predetermined level within the predetermined time. Preferably, the monitoring of the liquid level is accomplished by determining the liquid pressure in the bowl during filling. The filling step can be suspended if the liquid level does not reach the predetermined level within the predetermined time period. An alarm can be triggered indicating that the liquid level did not reach the predetermined level within the predetermined time period.

In another embodiment, the invention relates to an in-sink dishwasher capable of recirculating and/or draining the liquid when the drain is closed. The dishwasher comprises a sink having a bowl comprising a bottom wall from which extends a peripheral side wall, which collectively define a wash chamber with an open top for receiving dishes to be washed. A drain is fluidly connected to the wash chamber and is adapted to drain wash liquid from the wash chamber. A plug is provided to close the drain. The plug is removably mounted in the drain and sized to seat within the drain to fluidly close the drain. Liquid is circulated in the wash chamber by a liquid sprayer coupled to the wash chamber. A recirculation conduit supplies liquid to the liquid sprayer. The recirculation conduit has an outlet that is fluidly coupled to the liquid sprayer and an inlet that is fluidly coupled to the wash chamber such that the closing of the drain by the plug does not close the inlet, thereby permitting the recirculation of liquid in the wash chamber when the drain is closed by the plug.

The drain is typically located in the bottom wall of the sink to ensure proper drainage. The liquid sprayer can be implemented in a variety of ways. One way is by use of a spray arm that is fluidly coupled to the recirculation conduit. A basket can be provided for holding the dishes to be washed. When a basket is used, the spray arm can be mounted to the basket.

The dishwasher can further comprise a liquid level sensor, which is located in the drain at a position above the plug. A temperature sensor can also be provided and is located in the drain above the plug when the plug is seated.

The drain comprises a sump. A drain conduit fluidly connects the sump to drain liquid from the wash chamber through the sump. A plug seat can be located near the junction of the sump and the drain conduit. The plug rests against the plug seat when the plug closes the drain. At least one of the liquid level sensor and temperature sensor is located in the sump. The sensor can be located in the sump above the plug seat.

The recirculation conduit can include an inlet located in the sump and positioned above the plug seat. A recirculation drain conduit can be provided along with the recirculation conduit. The recirculation drain conduit has an inlet fluidly connected to the recirculation conduit and an outlet fluidly connected to the drain conduit at a location on the opposite side of the plug seat than the sump, to permit the draining of the liquid from the recirculation conduit when the plug is in place.

In yet another embodiment, the invention relates to an in-sink dishwasher comprising a sink having a bowl. The bowl has a bottom wall from which extends a peripheral side wall, which collectively define a wash chamber with an open top for receiving dishes to be washed. A drain is fluidly connected to the wash chamber and adapted to drain wash liquid from the wash chamber. The drain includes a plug seat adapted to mount a plug positioned in the drain to close the drain. A drain conduit is provided to bypass the plug and permit the draining of the wash chamber when the drain is plugged. The drain conduit has an inlet fluidly coupled to the drain above the plug seat and an outlet fluidly coupled to the drain below the plug seat to permit the draining of liquid from the wash chamber when the drain is closed by the plug. A plug can be provided for seating against the plug seat to close the drain. A liquid sprayer can be provided to spray liquid through out the wash chamber. A sensor can be positioned within the drain at a location above the plug seat. The sensor may be one of either a temperature sensor or a liquid level sensor.

The drain can comprise a sump and in which the sensor is located. A waste drain conduit fluidly connects to the sump and is adapted to be connected to a household drain for draining liquid from the wash chamber through the sump and to the household drain. The plug seat is located near the junction of the sump and the waste drain conduit. A pump can be fluidly coupled to the drain conduit to force the draining of the liquid from the wash chamber.

DESCRIPTION OF THE PREFERRED EMBODIMENT

Figure 1:
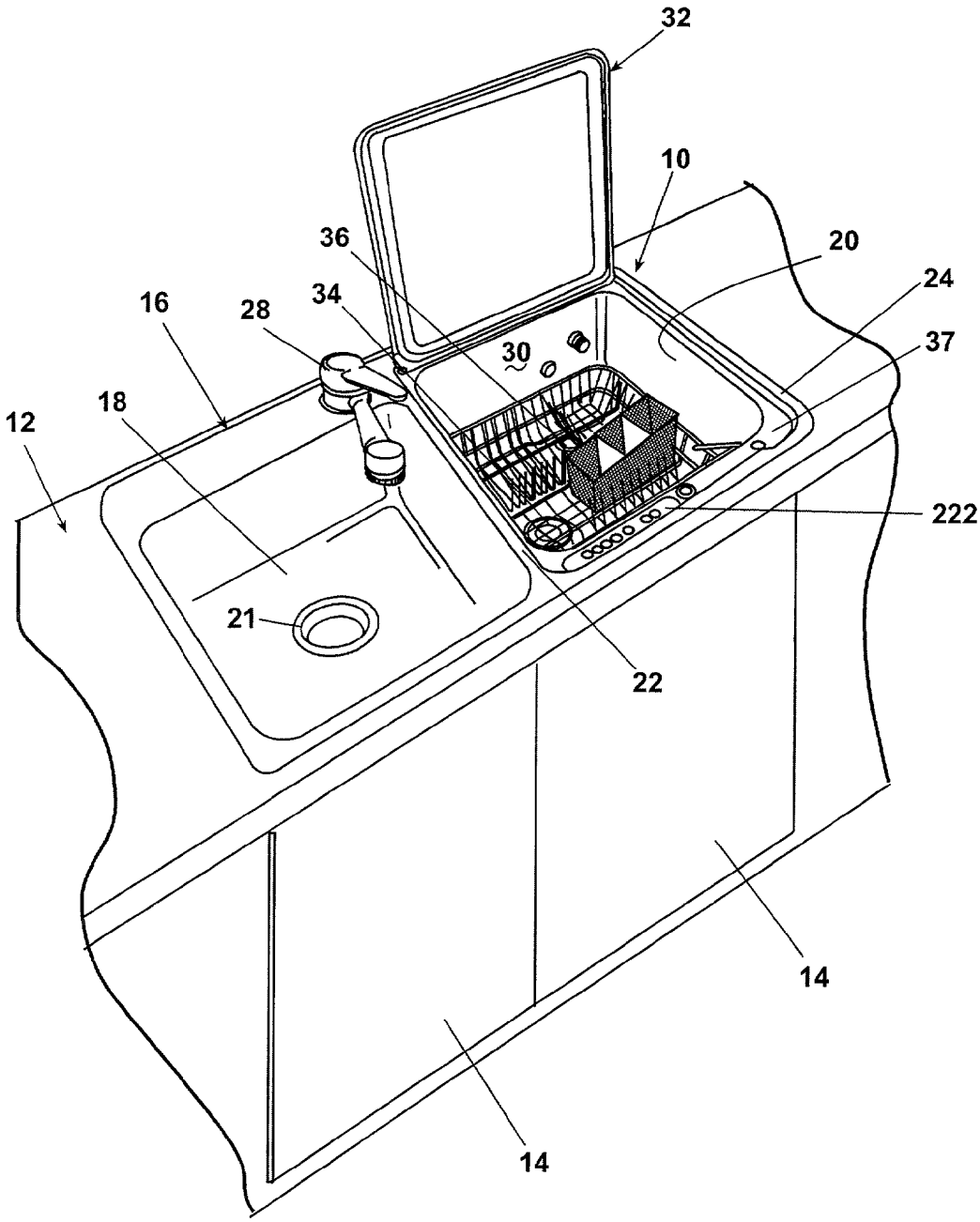
FIG. 1 is a perspective view of an in-sink dishwasher according to the invention, with the in-sink dishwasher shown mounted in a cabinet, the sink being of a double-bowl configuration and the one bowl forming part of the in-sink dishwasher having a lid, shown in an opened position, for covering the one bowl.
Figure 2:
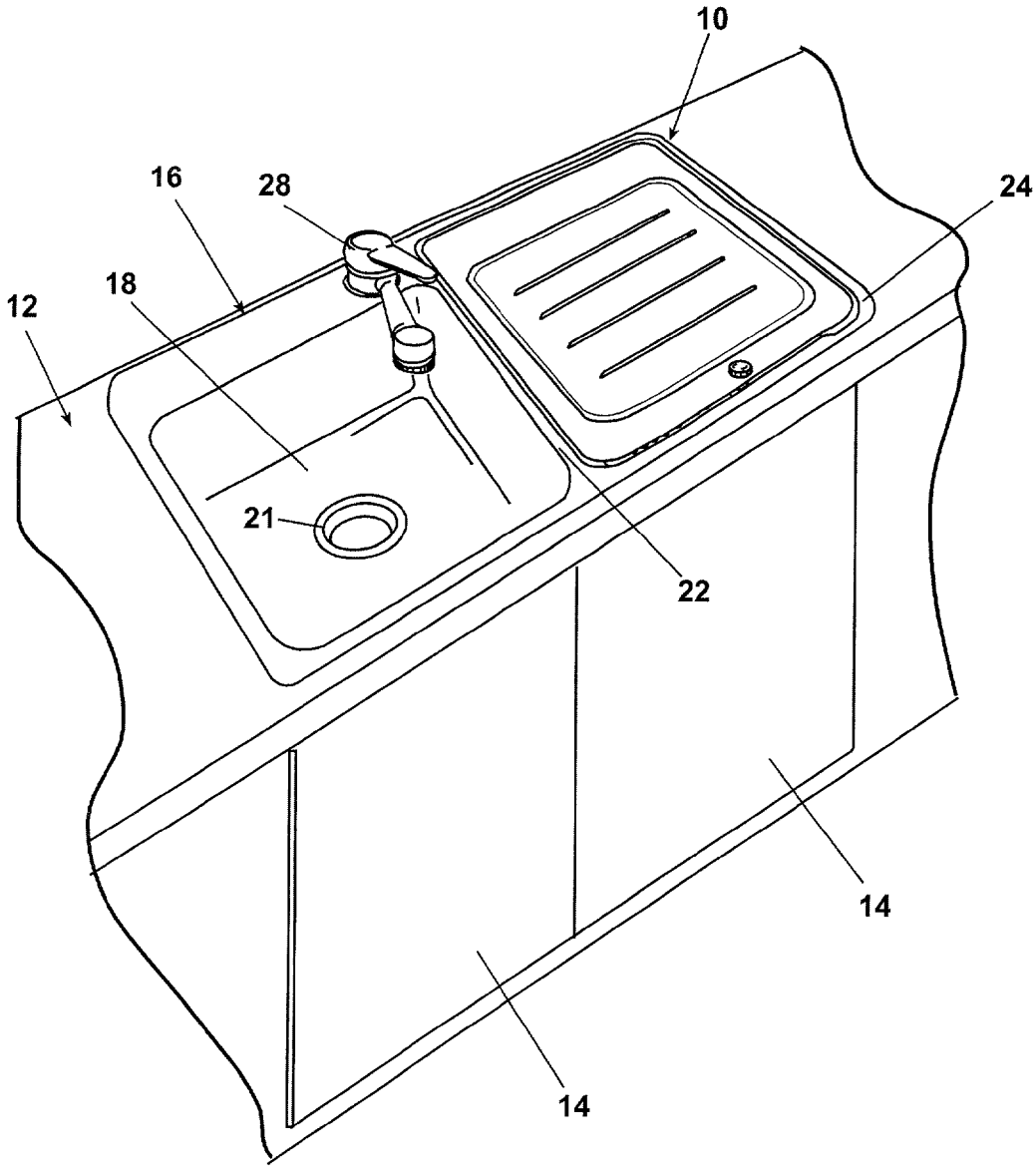
FIG. 2 is a perspective view identical to FIG. 1 except that the lid is shown in the closed position.

FIG. 1 illustrates an in-sink dishwasher 10 mounted in a traditional cabinet fixture 12 having doors 14 providing access to the cabinet interior where the lower portion of the in-sink dishwasher 10 is located.

The in-sink dishwasher 10 is illustrated in the environment of a double-bowl sink 16 comprising a first bowl 18 and a second bowl 20. The first bowl 18 performs the function of a traditional sink bowl and includes a drain opening 21. The second bowl 20 performs the dual function of a traditional sink bowl while also forming a portion of the housing for the in-sink dishwasher.

The first and second bowls 18, 20 are spaced from each other to define an intervening flange portion 22 that intersects a peripheral flange 24 surrounding both of the bowls 18, 20. Preferably, the double-bowl sink is made from stainless steel.

A traditional water faucet 28 is located in the peripheral flange 24 of the double-bowl sink and provides water to either of the first and second bowls 18, 20.

Figure 3:
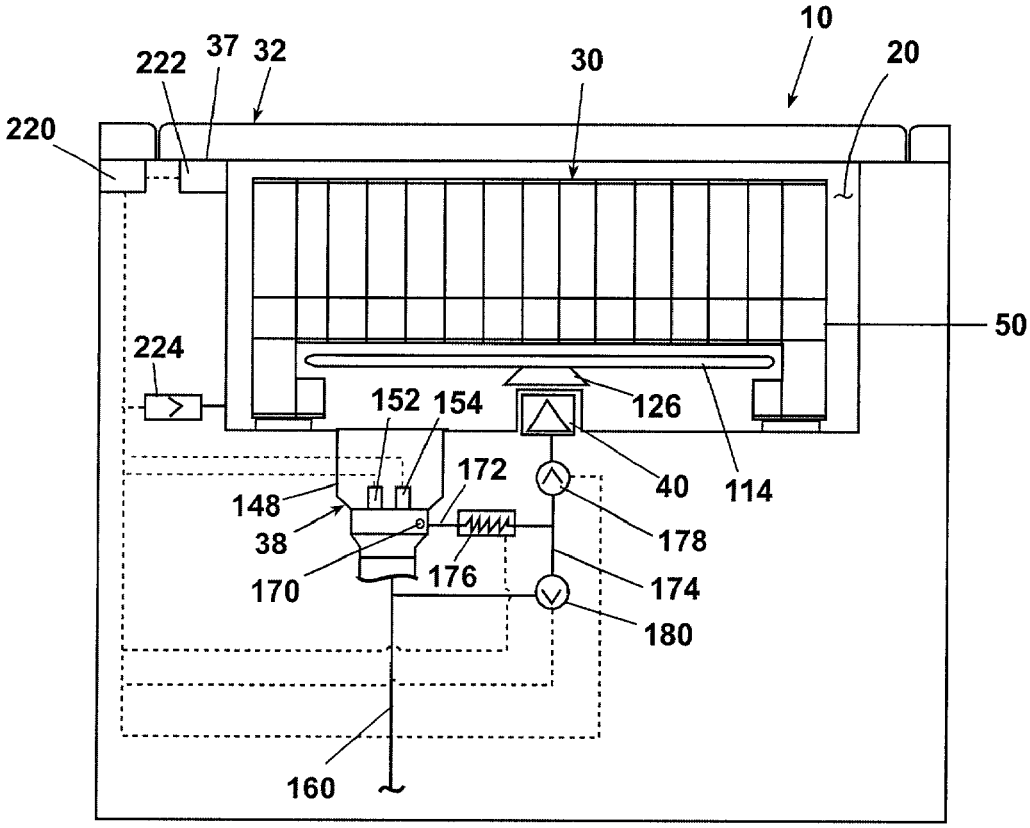
FIG. 3 is a schematic illustration of the major components of the in-sink dishwasher and their functional interaction.

Referring to FIG. 3 specifically and FIG. 1 generally, the in-sink dishwasher 10 comprises a wash chamber 30 that is defined by the second bowl 20, which has an open top. A lid 32 is hingedly mounted to the peripheral flange 24 of the double-bowl sink 16 and is movable between opened and closed positions to cover the open top of the second bowl 18 as shown in FIG. 1.

The second bowl 20 is formed by a peripheral wall 34 and a bottom wall 36. The peripheral wall 34 extends upwardly and away from the bottom wall 36 and terminates in a peripheral lip 37 disposed slightly below the peripheral flange 24, preferably such a distance that when the lid 32 is resting on the lip 37 in the closed position, the upper surface of the lid is approximate level with the peripheral flange 24.

A drain 38 is provided in the bottom wall 36. A self-aligning poppet valve 40 also is located in the bottom wall 36. Preferably, the self-aligning poppet valve 40 is centered in the bottom wall since the poppet valve 40 forms one part of a liquid coupling for supplying liquid to the wash chamber 30 when the second bowl 20 is used as an in-sink dishwasher.

FIG. 3 illustrates the major components of the in-sink dishwasher 10 used to implement the dishwashing function of the in-sink dishwasher. The components include a recirculation system comprising a liquid conduit 172 that fluidly connects the drain 38 to the to the wash chamber 20 whereby liquid in the wash chamber 20 is drawn from the drain 38 and reintroduced into the wash chamber 20. A spray arm 114 is fluidly coupled to the liquid conduit 172 to spray the recirculated liquid throughout the wash chamber 20.

The drain includes a sump 148 to which the liquid conduit is fluidly connected at a recirculation outlet 170. A recirculation pump 178 can be located in the liquid conduit 172 to pump the liquid from the sump and into the spray arm.

A drain system comprises a drain conduit 174 fluidly connecting the drain 38 to a traditional household waste drain 160. The drain system bypasses the plug used to close off the drain to thereby permit the draining of the wash chamber 20 when the drain 38 is plugged, which occurs during the dish-washing function.

The drain conduit 174 extends from the sump 148 to the waste drain 160. As illustrated the liquid conduit 172 and the drain conduit 174 share a common portion. It is within the scope of the invention for both the liquid and drain conduits 172, 174 to be separate conduits and have no common portions. A drain pump 180 is provided in-line with the drain conduit 174 to draw the liquid from the sump 148 and into the waste drain 160.

Sensors 152, 154 are located in the drain. The sensors are coupled to a controller 220, which controls the implementation of a wash cycle for the in-sink dishwasher. A user interface 222 is coupled to the controller and permits the user to select the desired wash cycle and the corresponding options, if any. The sensors supply operational information to the controller, such as temperature and liquid level, respectively. The controller then actuates the various components of the dishwasher, such as the recirculation and/or drain pumps, to implement the wash cycle. The sensors are located above where the drain 38 is plugged to ensure that they can provide data during the dish washing function.

Other components coupled to the controller 220 include a water inlet valve 224 that couples a water supply to the wash chamber 20. Actuation of the valve introduces water into the wash chamber 20 where the water can then be recirculated or drained as described. An in-line heater 176 is located in the liquid conduit 172 and is controlled by the controller to raise the temperature of the water passing through the liquid conduit.

Figure 4:
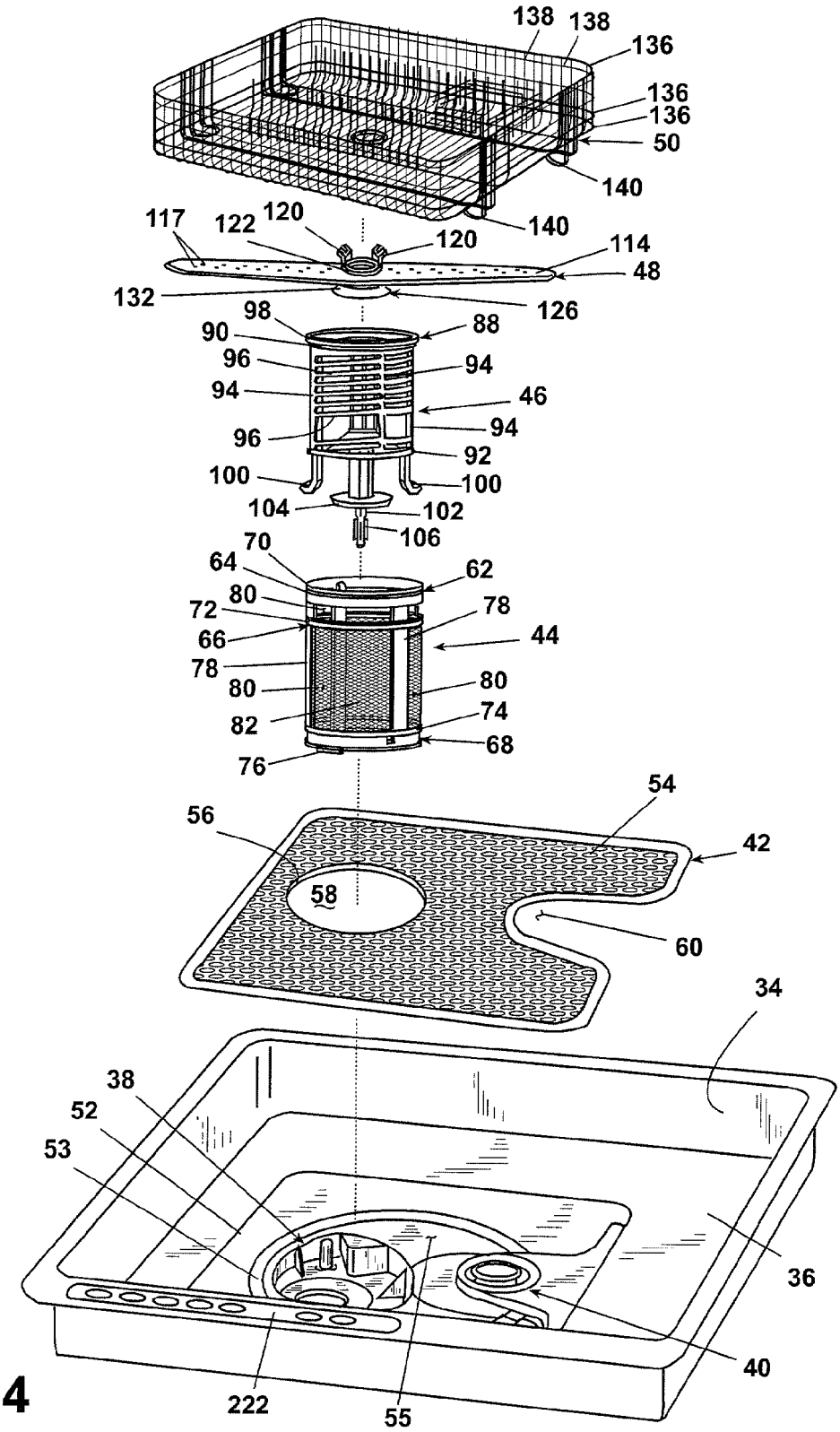
FIG. 4 is an assembly view of the in-sink dishwasher of FIG. 1 and illustrating the assembly of the major removable components of the in-sink dishwasher which include the basket, spray arm, drain plug, drain filter, and bottom screen.
Figure 5:
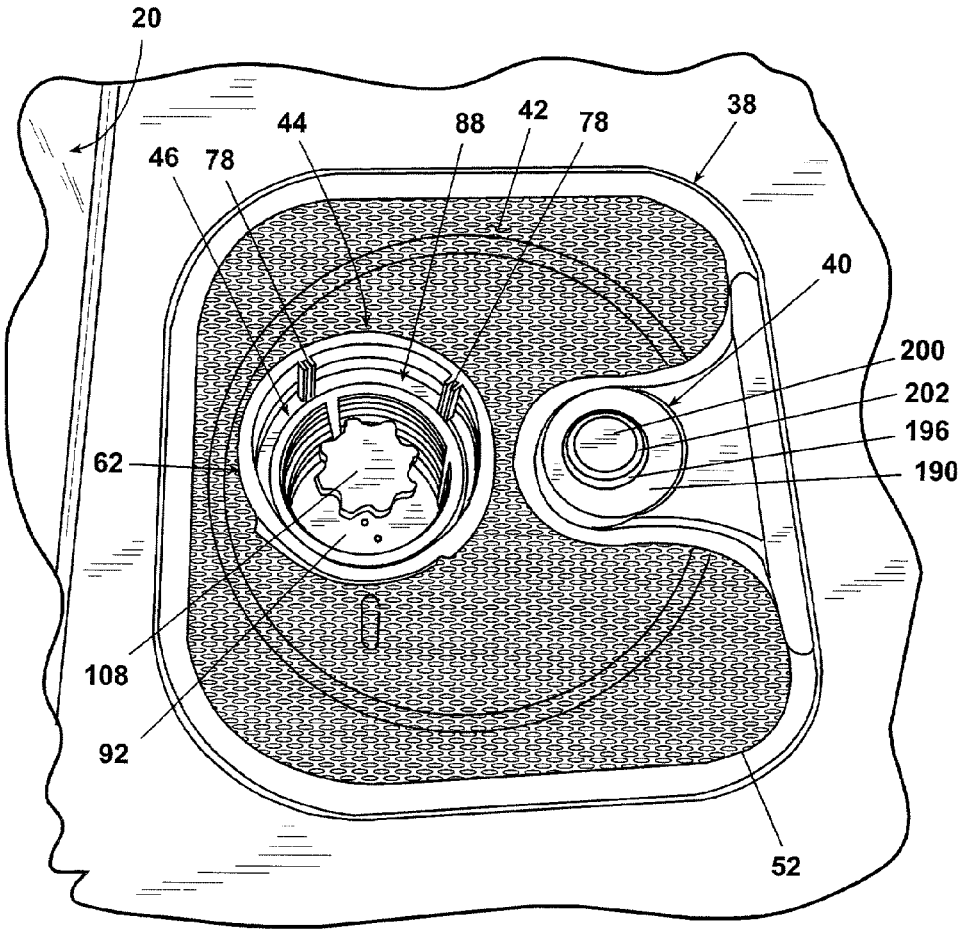
FIG. 5 is a top perspective view of the bottom of the sink of the assembled in-sink dishwasher and illustrating the liquid conduit including a poppet valve and its relationship to a sink drain, with the drain plug and drain filter received within the sink.

The remaining figures disclose the details of the in-sink dishwasher. FIGS. 3–5, disclose several removable components are provided for the in-sink dishwasher 10 and include a bottom screen 42, drain filter 44, drain plug 46, spray arm 114, and dish basket 50. The bottom screen 42 is preferably formed of a thin metal material, such as stainless steel, in which is formed a series of perforations or holes 54. A downwardly extending annular flange 56 is provided in the bottom screen 42 and defines a drain opening 58, which aligns with the drain 38 when the bottom screen 42 is mounted to the bottom wall 36. A recess 60 is formed on one side of the bottom screen 42 and is sized to receive the poppet valve 40 when the bottom screen 42 is positioned against the bottom wall 36.

Figure 6:
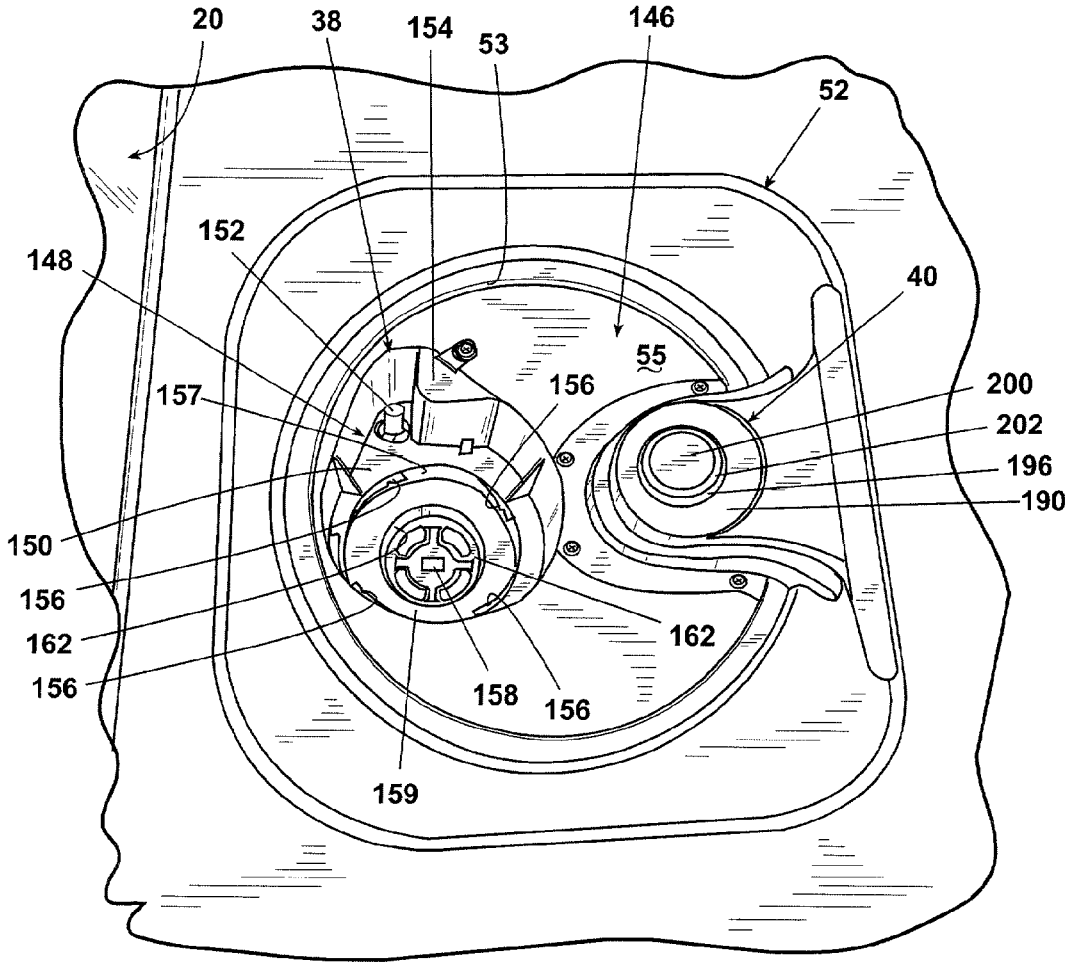
FIG. 6 is a top perspective view identical to FIG. 4 except that the drain plug, drain screen, and bottom screen are removed to better illustrate the sink drain and the temperature and pressure sensors located therein.

As best seen in FIGS. 4–6, the bottom wall includes a well 52 having an annular flange 53. The shape of the well 52 corresponds to the shape of the bottom screen 42 thereby permitting the bottom screen 42 to nest within the well 52 to mount the bottom screen 42 to the bottom wall 36. The annular flange 53 defines an opening 55 in which the drain 38 and the poppet valve 40 are located.

When the bottom screen 42 is positioned within the well 52, the upper surface of the bottom screen 42 effectively performs the function of, and is in alignment with, the upper surface of the bottom wall 36 surrounding the bottom screen 42. In other words, the bottom screen 42 forms a portion of the upper surface of the bottom wall 36 when the bottom screen 42 is used.

Referring to FIGS. 4 and 5, the drain filter 44 has a generally cylindrical shape with an open top and an open bottom. The drain filter 44 comprises a skeletal frame 62, preferably made from plastic, comprising top, middle, and bottom rings 64, 66, 68, each of which includes a corresponding shoulder 70, 72, 74. The bottom ring 68 includes locking lugs 76 forming part of a bayonet mount for securing the drain filter 44 within the drain 38. The rings 64, 66, 68 are connected by spaced rails 78 to thereby define a series of windows 80. A screen 82, preferably in the form of a fine wire mesh, is mounted to and is carried by the skeletal frame 62 such that the screen 82 overlies the windows 80 located between the middle and bottom rings 66, 68. The screen 82 functions as a filter for the drain 38.

Still referring to FIGS. 4 and 5, the plug 46 also has a generally cylindrical shape with an open top and a closed bottom, with an outer periphery small enough to be received within the interior of the drain filter 44. The plug 46 comprises a skeletal frame 88, preferably made from plastic, and comprising a top annular ring 90 and a bottom wall 92, which are connected by rails 94. A series of intermediate annular ribs 96 are integrally formed with the rails 94.

As best seen in FIG. 5, when the drain filter 44 and plug 46 are received within the drain 38, the top ring 64 of the drain filter 44 is positioned above the bottom wall 36 and bottom screen 42 and the middle ring 66 is adjacent to or in contact with the bottom screen 42. The top ring 90 of the plug 46 is in contact with the middle ring 66 of the drain filter 44. Therefore, liquid can pass through the windows 80 between the top rings 64 and the middle ring 62 and flow into the interior of the plug 46, where the liquid will then pass through the skeletal frame 88 of the plug 46, through the screen 82 of the drain filter 44, and into the drain 38, to filter particulates from the liquid.

The top annular ring 90 also includes a shoulder 98. Multiple feet I 00 extend downwardly from the bottom wall 92. A stopper support 102 extends downwardly from the bottom wall 92 and carries a stopper 104, preferably made from a suitable rubber or plastic. The stopper support 102 terminates in a key 106, which cooperates with the drain 38 to fix the position of the plug 46 in the drain 38. A knob 108 extends upwardly into the interior of the skeletal frame 88 from the bottom wall 92. The knob 108 aids in rotating the plug 46.

Figure 7:
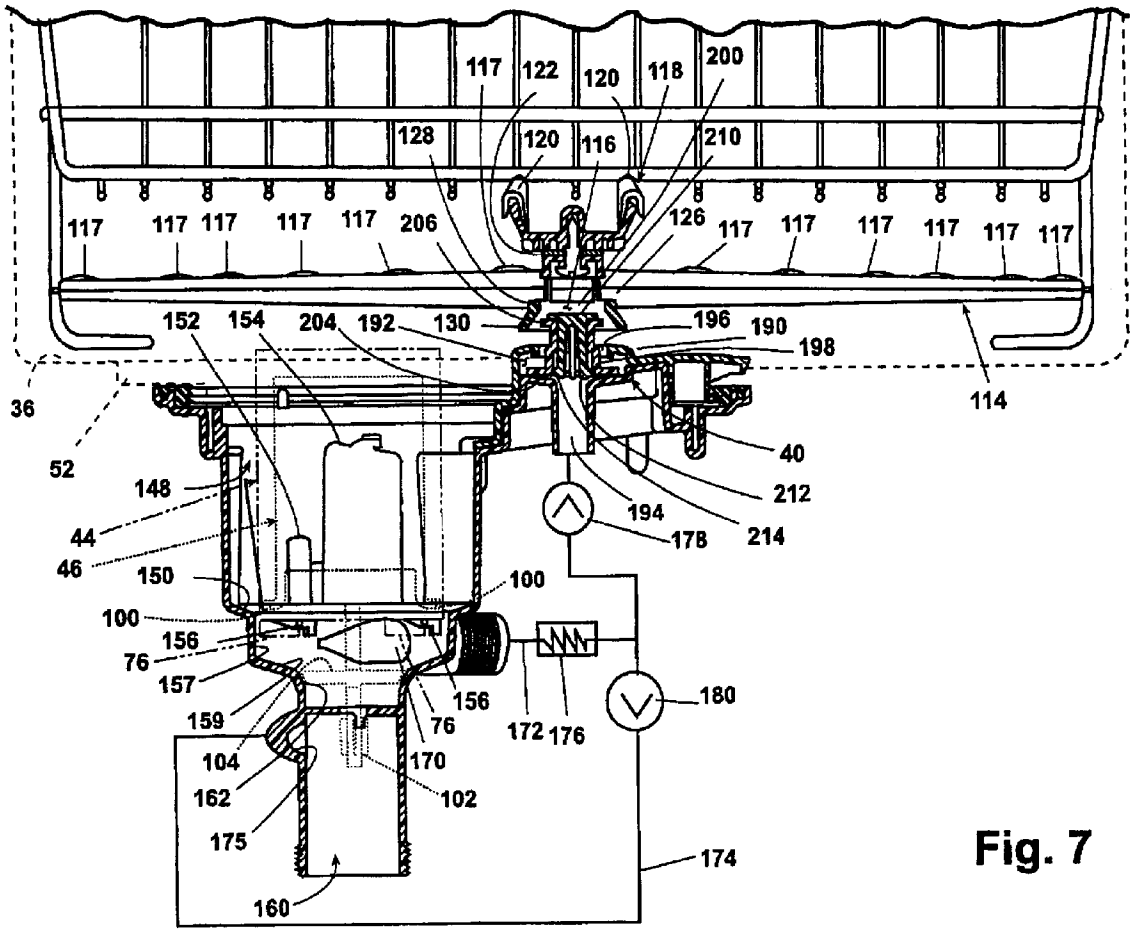
FIG. 7 is a side sectional view of the assembled basket, spray arm, poppet valve, and drain with the poppet valve shown in the closed position and the basket in an unseated position.

Referring to FIGS. 4 and 7, the spray arm assembly 48 comprises a hollow spray arm 114, preferably made from stainless steel, with a liquid inlet 116 formed in a lower surface and spray outlets 117 formed on an upper surface. A mounting bracket 118 is secured to the upper surface of the spray arm 114 and includes resilient hooks 120 for snap-fitting with the basket 50 and a rotatable coupling 122 that rotatably mounts the spray arm 114 to the resilient hooks 120. Thus, the mounting bracket 118 provides for the snap-fit mounting of the spray arm 114 to the basket along with permitting the spray arm 114 to rotate relative to the basket 50.

A deflector 126 is mounted to the lower surface of the spray arm 114 and circumscribes the liquid inlet 116. The deflector 126 comprises an annular collar 128 from which extends an angled surface 130, terminating in an annular lip 132. The annular collar 128 and angled surface 130 form a funnel-type structure leading to the liquid inlet 116. The diameter of the angled surface 130 is greater than the diameter of the liquid inlet 116. The deflector 126 forms part of a coupling that automatically aligns the liquid inlet 116 with the poppet valve 40.

Referring to FIGS. 4 and 7, the basket 50 is made from multiple coated wires in a well-known manner and will not be described in great detail. The basket includes multiple peripheral wires 136, forming the outer periphery of the basket side wall, and multiple U-shaped wires 138 laterally spanning the peripheral wires 136 to form the basic basket shape. Feet 140 are formed by wires extending from the side of the basket. The feet 140 are preferably L-shaped and extend below the bottom of the basket so that the bottom of the basket will be spaced from the bottom wall of the sink when the feet touch the bottom wall.

Referring to FIGS. 6-7, the drain 38 is shown in greater detail. The drain 38 is preferably made from plastic and includes a top wall 146 and in which is formed the sump 148. The top wall 146 mounts to the annular flange 53 of the sink bottom wall 36. An annular platform or shoulder 150 is formed within the interior of the sump 148 and provides a support on which are mounted the temperature sensor 152, preferably in the form of a thermistor, and the liquid level sensor 154, preferably in the form of a dome-type pressure sensor.

Spaced mounting lugs 156 extend radially inwardly from a side wall 157 of a reduced diameter portion of the sump 148, which terminates in a second shoulder 159. The lugs 156 are located axially beneath the shoulder 150. The mounting lugs 156 cooperate with the lugs 76 on the skeletal frame 62 of the filter 44 to permit the bayonet mounting of the filter 44 to the sump by rotation of the skeletal frame 62.

A key hole 158 is located in the center of a waste drain portion 160 of the sump 148 and below the lugs 156. An annular angled sealing surface 162 provides the transition from the second shoulder 159 to the waste drain 160. The key hole 158 cooperates with the key 106 on the end of the stopper support 102 of the plug 46 for securing the plug to the sump 148.

When the drain filter 44 is received within the sump 148 and secured by the interacting lugs 76 and 156, the shoulder 74 of the bottom ring 68 will bear against the platform 150 and/or the side wall 157 to effect a seal between the filter 44 and the sump 148. The outline of the drain filter 44 is shown in phantom in FIG. 7 to illustrate the location of the drain filter when it is located within the drain.

When the plug 46 is secured to sump 148 by the cooperation between the key 106 and the keyhole 158, the stopper 104 is compressed against the annular sealing surface 162 to close off the waste drain 160. The outline of the plug 46 is shown in phantom in FIG. 6 to illustrate the location of the plug when it is located within the drain.

The recirculation inlet 170 is formed in the side wall 157 of the sump 148 below the lugs 156 and above the annular sealing surface 162. The recirculation inlet 170 is connected to the poppet valve 40 by the liquid conduit 172, which is shown schematically in FIGS. 3 and 7. The recirculation inlet 170 permits liquid flow in the sump 148 to be directed through the conduit 172 to the poppet valve 40 and into the spray arm 114, when the basket 50 is seated within the second bowl 20 to establish a recirculation loop where liquid can be continuously recirculated from the sump and onto the dishes contained in the basket 50.

The recirculation inlet 170 of the sump 148 is positioned above the annular sealing surface 162 so that when the stopper 104 of the plug 46 closes the waste drain 160, liquid can still be drawn into the recirculation loop through the recirculation inlet 170. The recirculated liquid will be drawn through the drain filter to ensure that particulates in the liquid are not recirculated back onto the dishes.

A recirculation drain 175 is fluidly connected to the waste drain 160 below the keyhole 158. The recirculation drain 175 is also fluidly connected to the conduit 172. The fluid connection of the recirculation drain 175 between the waste drain 160 and the liquid conduit 172 permits the draining of the liquid in the recirculation loop even when the drain plug 46 has closed off the waste drain 160.

Referring to FIGS. 3 and 7, an in-line liquid heater 176 and the recirculation pump 178 are fluidly connected to the liquid conduit 172 and form part of the recirculation loop. The in-line water heater 176 is used to receive liquid passing through the conduit 172 and the recirculation pump 178 pumps liquid through the recirculation loop.

The drain pump 180 is also fluidly connected to the liquid conduit 172 as well as to the recirculation drain 175. The drain pump 180 permits the liquid in the recirculation loop to be drained from the wash chamber through the sump when the drain plug 46 has closed the waste drain 160.

The recirculation pump 178 and drain pump 180 act both as a valve and a pump since when the pumps are turned off, water cannot pass through the pump. Therefore, both pumps can be coupled to the liquid conduit 172 without interfering with the flow of liquid through the recirculation loop or the draining of liquid from the recirculation loop. It is possible for a single pump with multiple outlets to be used in place of separate recirculation in drain pumps.

The poppet valve 40 is best seen in FIGS. 5-7. The poppet valve 40 comprises a housing 190 that is mounted to the top wall 146 and defines a chamber 192 therebetween that is fluidly connected to the liquid conduit 172 by an inlet 194 formed in the top wall 146. A liquid outlet opening 196 is formed in the housing 190. The chamber 192 can be thought of as essentially a continuation of the conduit 172 and the liquid outlet opening 196 can be thought of as an outlet for the liquid conduit 172.

A poppet assembly comprising a feed tube 198 and a poppet 200 extend from the poppet chamber 192 through the liquid outlet opening 196. The feed tube is hollow and has an annular base 204 and top annular rim 206.

The poppet comprises cap 210 from which depend resilient legs 212, which terminates in radially extending feet 214. The resilient legs 212 are located along the cap 210 such that they can be received through the hollow interior of the nozzle 202. The feet 214 extend a sufficient radial distance so that they will bear against a shoulder in the interior of the nozzle 202 to limit the axial movement of the poppet 200 relative to the nozzle 202.

The operation of the poppet valve 40 is dependent on whether or not there is pressurized liquid being directed through the liquid conduit 172. When there is no pressurized liquid acting on the poppet valve 40, the poppet valve is as it appears in FIG. 6. In such an unpressurized condition, the base 204 is spaced from the liquid outlet opening 196 of the housing 190 and rests on the top wall 146 circumscribing and enclosing the poppet chamber inlet 194. The cap 210 of the poppet 200 rests on the annular rim 206 of the nozzle 202 to close off the hollow interior of the nozzle 202.

When there is pressurized liquid acting on the poppet 40, the pressurized liquid forces the feed tube 198 upwardly until the base 204 contacts the housing 190 to seal the liquid outlet opening 196. The pressurized liquid must then pass through the hollow interior of the nozzle 202 where it contacts the cap 210 of the poppet to raise the cap above the annular rim 206 of the nozzle 212 and permits fluid flow through the nozzle 200 to and between the cap 210 and the annular rim 206.

In the pressurized condition, the cap 210 forms a spray head for the poppet valve 40 and forms outlet openings defined by the gaps between the cap 210, annular rim 206, and legs 212. Since the cap 210 and annular rim 206 are radially extending, the defined outlet openings are inherently laterally extending, resulting in any liquid passing through the poppet valve 40 to be directed laterally toward the peripheral wall 34 of the bowl 20. In other words, the axial flow of the pressurized liquid through the nozzle 202 is laterally deflected when it contacts the cap 210 to direct the pressurized liquid laterally toward the peripheral wall 34 of the bowl 20.

The operation of the in-sink dish washer is controlled by the controller 220 in the general manner as previously described. Preferably, the controller is a microprocessor-based controller, used to control the operation of the in-sink dishwasher and the electrical coupling of the controller to the in-line heater 176, recirculation pump 178, drain pump 180, inlet valve 224, liquid level sensor 154, and temperature sensor 152 to control their respective operations. (Also controls detergent and/or RIA dispenser and RIA level sensor but may not be important enough to mention}

The controller 220 preferably has multiple pre-programmed wash cycles stored within the memory of the controller. There are many well-known wash cycles such as Regular Wash, High Temperature or Sanitizing Wash, China Wash, Wash with Pre-Soak, and Pots and Pans Wash, to name a few. The wash cycles typically comprise multiple steps, the building blocks of which include introducing and recirculating a charge of water into the wash chamber. Some steps can include the addition of a detergent. Other steps might include heating the water. The exact cycles and steps are not germane to the current invention other than the controller 220 for the in-sink dish washer is capable of performing one or more wash cycles.

To perform a wash cycle, the controller 220 operates the in-line heater 176, recirculation pump 178, drain pump 180, and inlet valve 224, along with data from the water level sensor 154 and the temperature sensor 152. The controller generally includes an internal clock that handles timing functions and internal counters for any cycle functions.

A user interface 222 is located in the peripheral flange 37 and is electronically coupled to the controller 220. The user interface 222 permits the user to select the desired wash cycle from the multiple wash cycles stored in the memory of the controller 220 and enter any necessary or optional operating data or parameters for the wash cycles. The user interface preferably includes one or more visual or audible indicators used to display information to the user. For example, lights, preferably light-emitting diodes ("LEDs"), can be illuminated adjacent descriptive text or symbol on the user interface to indicate an associated status. Common uses of the visual or audible indicators are to signal an error in the wash cycle, or the completion of one or more steps in the wash cycle or the entire wash cycle.

All of the wash cycles traditionally used in an automatic dishwasher or an in-sink dishwasher require the recirculation of liquid, with or without detergent, through the wash chamber to perform one step of the wash cycle. For example, during a rinse step of the overall cycle, water is introduced into the wash chamber and subsequently recirculated for a predetermined time. During a wash step, detergent is mixed with the water introduced into the wash chamber. The recirculation of the water with the detergent forms a wash liquid that is then recirculated through the wash chamber to clean the additions. To effect such a recirculation. of liquid, the controller 220 ensures that the drain pump 180 is shut off, which prevents liquid from leaving the liquid conduit 172 and draining through the recirculation drain 175. The controller 220 energizes the recirculation pump 178 to recirculate the liquid from the sump 148, through the spray arm 114, onto the dishes in the basket 50, and the liquid subsequently flows back into the sump 148 where it is recirculated.

To drain the liquid from the wash chamber when the sink is operated as an in-sink dishwasher 10, meaning that the plug 46 is in place and closing the waste drain 160, the controller 220 ensures that the recirculation pump 178 is turned off to prevent the recirculation of the liquid within the liquid conduit 172. The controller 220 energizes the drain pump 180 which pumps the liquid from the sump 148 through the liquid conduit 172 and into the recirculation drain 175, which flows into the waste drain 160 to thereby drain the liquid from the sump.

Figure 8:
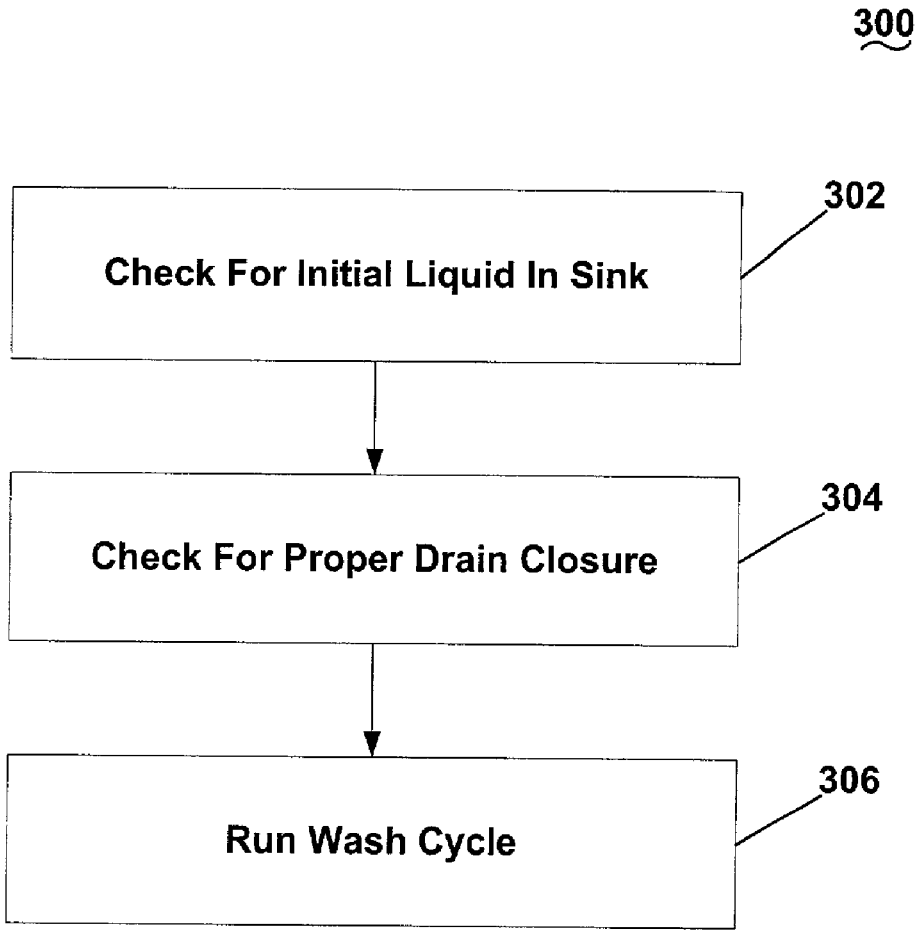
FIG. 8 is a flowchart illustrating the overall method for controlling the liquid filling of the in-sink dishwasher according to the invention.

FIG. 8 illustrates the overall process for controlling the operation of the in-sink dishwasher 10, with the process including a liquid level check and a drain closed check. Upon the initiation of the overall process 300, the controller 220 first checks for the presence of liquid in the sink in step 302. If there is liquid in the sink at the beginning of the process, it is preferred that the liquid be drained prior to the continuation of the process, especially if the liquid is of an amount that would interfere with the operation or performance of the in-sink dishwasher. Alternatively, an error signal can be issued and the process paused or terminated. Assuming there is no liquid in the sink, the overall process continues and checks for proper drain closure in step 304. If the drain 38 is not properly closed, the process preferably will be paused and a corresponding error signal is sent, such as a visual and/or audible signal. Upon the passing of the test for the initial liquid in the wash chamber and the proper drain closure, the process will run the selected wash cycle 306.

Figure 9:
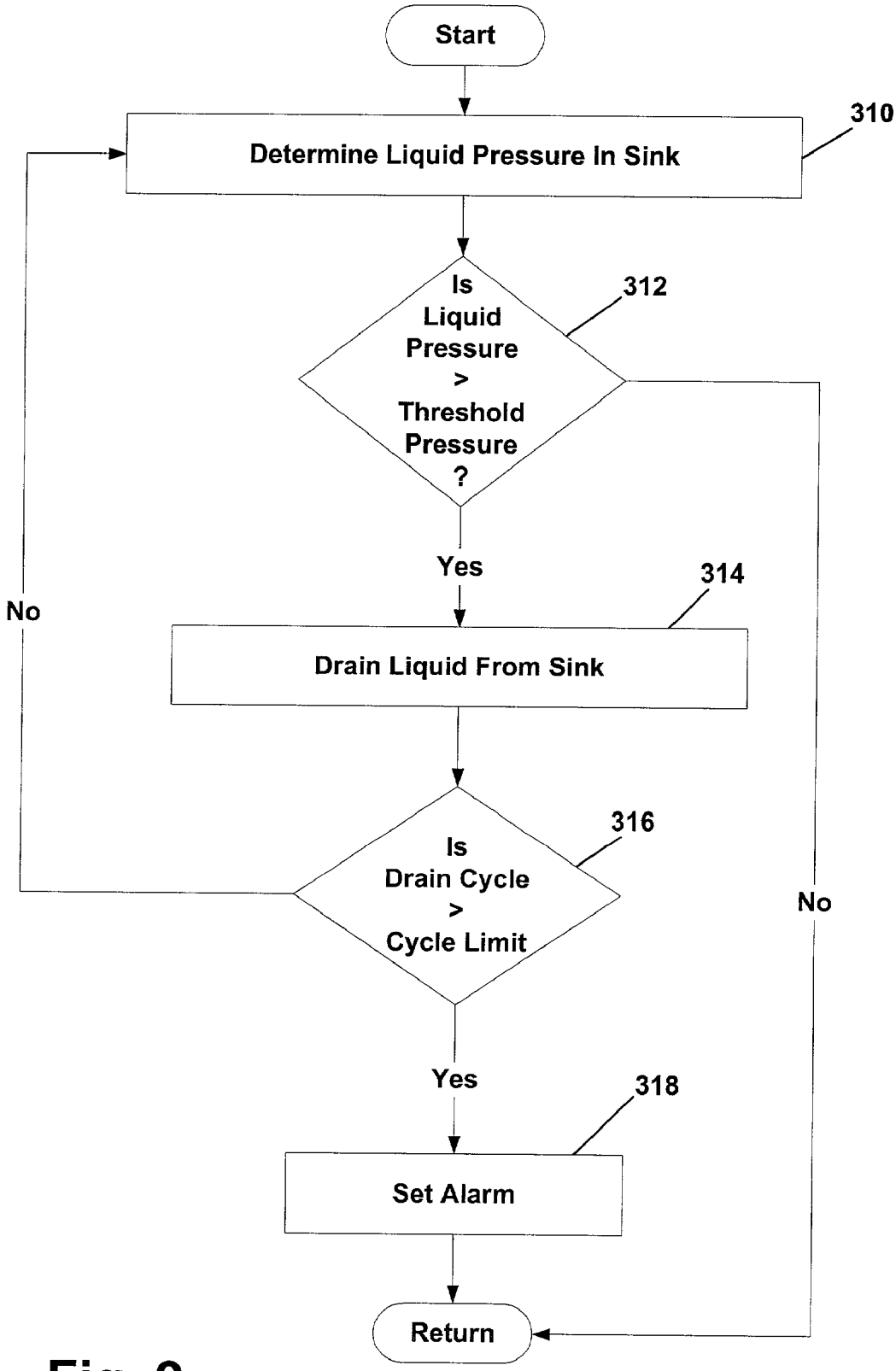
FIG. 9 is a flowchart illustrating the process for determining if the wash chamber is filled with water prior to the initiation of the wash cycle.

The major steps in testing for the presence of liquid in the sink at step 302 are shown in FIG. 9. The testing for presence of liquid in the sink begins by first checking the level of the liquid, if any, in the sink, which is preferably accomplished by determining the liquid pressure in the sink at step 310. The liquid pressure is determined by the controller 220 receiving data from the pressure sensor 154.

The determination of the liquid pressure can be done in many well-known ways. For example, the signal from the pressure sensor is normally a voltage, and the magnitude of the voltage is generally proportional to the pressure. The controller 220 can have stored in its memory a table of voltages and their corresponding pressure and/or water level values. The controller 220 can use the voltage from the sensor to look up the corresponding pressure and/or water levels. To reduce the memory requirements of the controller 220, the controller can contain a formula or algorithm that converts the voltage signal from the sensor into a water level or pressure. Another, and preferred example, is that the controller can detect contacts of pressure switch set to change state at a known pressure level.

The presence of a small amount of liquid in the sink at the beginning of the wash cycle will not interfere with the proper operation of the in-sink dishwasher 10. Therefore, the liquid pressure determined in step 310 is preferably compared to a threshold pressure in step 312. A determined liquid pressure less than the threshold pressure is indicative of a small amount of water that will not interfere with the proper operation and cleaning performance of the in-sink dishwasher 10.

If the determined liquid pressure is less than the threshold pressure, then there is no liquid present in the wash chamber at the beginning of the cycle, or the amount of liquid present is not sufficient to interfere with the operation and performance of the in-sink dishwasher 10 and control is returned to the overall program 300.

If the determined liquid pressure is greater than the threshold pressure, then the amount of liquid warrants removal and the liquid is drained from the sink at step 314. The draining of the liquid from the sink at step 314 is accomplished by the controller 220 energizing the drain pump 180. It is preferred that the controller 220 only energize the drain pump for a predetermined period of time, which can be controlled by the internal clock of the controller 220 at step 316. The time the drain pump 180 is energized is preferably long enough to ensure the removal of a volume of water equal to the capacity of the sink. The process then returns to step 310 and a new liquid pressure is determined and the process is repeated.

Prior to determining the new liquid pressure, the controller 220 at step 316 increments an internal timer or counter corresponding to the number of cycles that the drain pump is actuated in step 314 and checks to see if the timer or counter exceeds a predetermined value. Step 316 is optional in that it is used to determine if the pressure sensor has failed, the drain pump has failed, or there is some other problem with the system, since a failure is the most likely reason the activation of the drain pump in step 314 would not serve to remove the water such that the next check of the liquid pressure is not below the threshold pressure.

If the drain time or number of drain cycles exceeds the predetermined cycle limit, then control passes to step 318 where an alarm is set and the overall process 300 is suspended or terminated. The alarm at step 318 can be one or both of a visual or audio alarm. It preferably includes a visual display. After the completion of the alarm, control is returned to the main process 300. When control is returned to the main process, it is preferred that the main process is paused and the user will have to remedy the problem and restart the process. Alternatively, the main process 300 can be terminated. There are many well-known processes for handling the process when an error is reached. Such error handling processes are not germane to the current invention. Any of the well-known processes can be used.

It is worth noting that while the preferred process at step 314 includes running the drain pump 180 for a predetermined time, the same type of control can be accomplished by continuously running the drain pump 180 while periodically checking the current liquid pressure as in step 310. With such an implementation, the test for the number of cycles in step 316 would be replaced with a test for the passing of a time threshold. That is, step 316 would start a clock and upon the expiration of a predetermined time, if the determined liquid pressure is not below the threshold pressure, the drain pump 180 would be shut off and control would pass to step 318.

Figure 10:
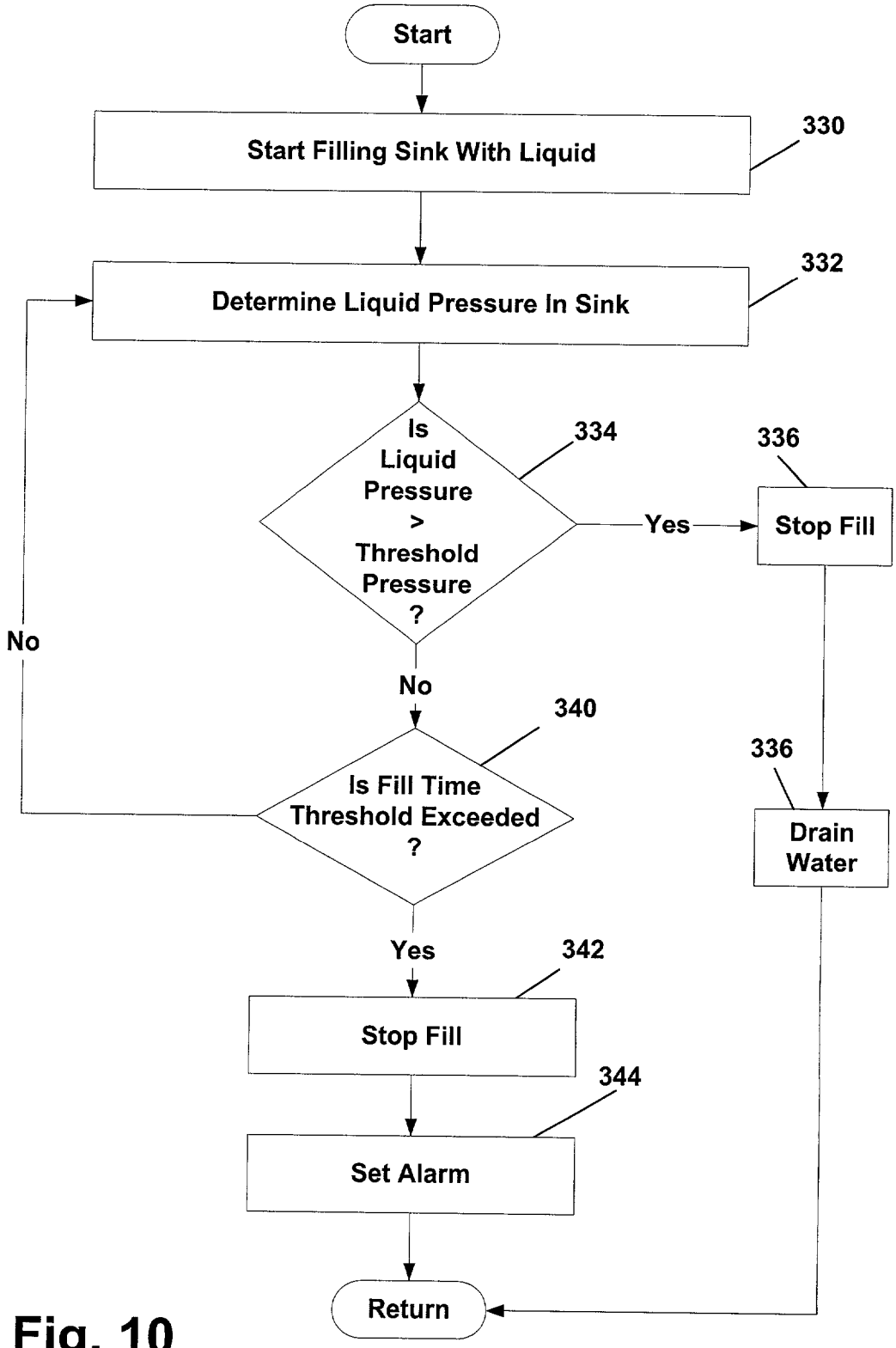
FIG. 10 is a flowchart illustrating the process for determining if the drain is properly sealed.

Referring to FIG. 10, the process for testing for proper drain closure is illustrated. This test is unique to the in-sink configuration because the user must manually close the drain by inserting a stopper or plug into the bottom of the drain to close off the traditional sink drain. If the traditional sink drain is not closed, any water introduced into the wash chamber will drain out. This is not a concern for a traditional dishwasher since the drain normally includes a valve or pump.

To test for a properly closed drain, water is introduced into the sink at step 330. The water is introduced into the sink by the controller 220 activating the inlet valve 224 to permit the introduction of water from the household water supply into the drain 34 to begin filling the wash chamber. After the initiation of the filling or introduction of water into the sink at step 330, the liquid pressure of the water in the sink is determined at step 332. The determined liquid pressure is then compared against a threshold pressure in step 334. If the determined liquid pressure is greater than the threshold pressure, it is presumed that the drain is properly in place and that the water is not draining from the sink. In such a circumstance, control passes to step 336, which stops the introduction of water into the sink by shutting off or closing the inlet valve 224. Control then returns to the main process 300.

If the determined liquid pressure is less than the threshold pressure, then either lo insufficient time has lapsed for the water to fill to the desired level or the drain is not properly closed. The process then moves to step 340 to determine if the fill time has lapsed, which, if true, would indicate that the drain is not properly closed. If the fill time, that is the time since the initiation of step 330, has not exceeded the threshold fill time, insufficient time has passed for the liquid to reach the desired level that would correspond to the threshold pressure given the flow rate of the valve 224 and control is returned to step 332 for the determination of a current liquid pressure. The filling is continued until either the liquid pressure is greater than the threshold pressure or the fill time exceeds the fill time threshold.

If the fill time threshold is exceeded, it is assumed that the drain is not properly closed and control is transferred to step 344 where the inlet valve 224 is shut off to stop the filling of water into the wash chamber. An alarm is then set in step 344, which indicates that the drain is most likely improperly closed. Control then returns to the main program 100, which will require user interaction to re-start the process.

Assuming that the checks for pre-existing liquid and proper drain closure at steps 302 and 304 are passed, control passes to step 306 to run the selected wash cycle. It should be noted that, although the check for proper drain closure in step 304 is identified as being separate from the running of the wash cycle in step 306, it is within the scope of the invention for step 304 to be part of the wash cycle step 306. All wash cycles, either as the first or subsequent step, introduce a charge of water into the wash chamber. The check for proper drain closure in step 304 can be combined with the introduction of the charge of water into the wash chamber found in most wash cycles. Combining the check for the proper drain closure step 304 with a step of the wash cycle in step 306 conserves energy and water as compared to having a separate fill and drain just to check the drain closure.

While the invention has been specifically described in connection with certain specific embodiments thereof, it is to be understood that this is by way of illustration and not of limitation, and the scope of the appended claims should be construed as broadly as the prior art will permit.

What is claimed is:

1. An in-sink dishwasher comprising:

a sink having a bowl comprising a bottom wall from which extends a peripheral side wall, which collectively define a wash chamber with an open top for receiving dishes to be washed; the bottom wall of the sink comprising first and second spaced apertures; the first aperture being positioned off-center in the bottom wall of the sink bowl for allowing liquid to flow out of the wash chamber and the second aperture being centrally located in bottom wall of the sink bowl for allowing liquid to be re-introduced into the wash chamber;

the first aperture for accommodating a first drain for allowing wash liquid to flow out of the wash chamber;

the second aperture for accommodating a liquid sprayer for allowing liquid to be re-introduced into the wash chamber;

a plug removably mounted in the first drain and for fluidly closing the first drain; and a recirculation conduit coupled between the first drain and the liquid sprayer for forming a liquid recirculation loop between the wash chamber, first drain and liquid sprayer, wherein draining of liquid in the recirculation loop is not restricted when the first drain is closed by the plug.

2. The in-sink dishwasher according to claim 1 wherein the liquid sprayer comprises a spray arm fluidly coupled to the recirculation conduit.

3. The in-sink dishwasher according to claim 2, further comprising a basket received within the wash chamber and the spray arm is mounted to the basket.

4. The in-sink dishwasher according to claim 1, further comprising a liquid level sensor located in the first drain at a position above the plug when the plug is received in the first drain.

5. The in-sink dishwasher according to claim 1, further comprising a temperature sensor located in the first drain at a position above the plug when the plug is received in the first claim.

6. The in-sink dishwasher according to claim 1 wherein the first drain comprises a sump and at least one of a liquid level sensor and a temperature sensor is located in the sump.

7. The in-sink dishwasher according to claim 6 wherein the recirculation conduit comprises an inlet in the sump and the inlet is located above a plug seat positioned near a junction of the sump and a waste drain conduit, wherein the plug rests against the plug seat when the plug closes the first drain.

8. The in-sink dishwasher according to claim 1, further comprising a recirculation drain conduit having an inlet fluidly connected to the recirculation conduit and an outlet fluidly connected to a waste drain conduit at a location spaced from the first drain, thereby permitting the draining of the liquid from the recirculation conduit when the plug is received within the first drain.

9. The in-sink dishwasher according to claim 8, further comprising a recirculation pump for pumping wash liquid through the recirculation conduit and into the liquid sprayer and a drain pump for pumping wash liquid from the recirculation drain conduit to the waste drain conduit for allowing liquid to be drained from the wash chamber when the plug is seated in the first drain and the first drain is closed.

10. The in-sink dishwasher according to claim 1, further comprising a drain conduit having an inlet fluidly connected to the first drain above the plug when the plug is seated within the first drain, and an outlet fluidly connected to a recirculation drain below the plug when the plug is seated in the first drain whereby liquid can be drained from the wash chamber when the plug is seated and the first drain is closed.

11. The in-sink dishwasher according to claim 1, further comprising an in-line heater positioned in the recirculation conduit for heating wash liquid passing through the recirculation conduit.

12. The in-sink dishwasher according to claim 11 wherein the in-line heater is positioned between the first drain and the liquid sprayer in the recirculation loop.

13. An in-sink dishwasher comprising:

a sink having a bowl comprising a bottom wall from which extends a peripheral side wall, which collectively define a wash chamber with an open top for receiving dishes to be washed;

a first drain fluidly connected to the wash chamber for draining wash liquid from the wash chamber;

a liquid sprayer fluidly connected to the wash chamber for introducing wash liquid to the wash chamber;

a recirculation conduit coupled between the first drain and the liquid sprayer for forming a liquid recirculation loop between the wash chamber, the first drain and the liquid sprayer;

a plug removably mounted in the first drain for fluidly closing the first drain but not restricting flow of liquid in the recirculation loop when the first drain is closed by the plug; and a recirculation drain fluidly connected to the recirculation conduit and spaced apart from the first drain for draining liquid in the recirculation loop when the plug closes off the first drain.

14. The in-sink dishwasher according to claim 13, further comprising a sensor positioned within the first drain at a location above a plug seat positioned near a junction of a sump on the first drain and a waste drain conduit, wherein the plug rests against the plug seat when the plug closes the first drain.

15. The in-sink dishwasher according to claim 14 wherein the sensor is one of a temperature sensor and liquid level sensor.

16. The in-sink dishwasher according to claim 14 wherein the first drain comprises a sump and the sensor is located in the sump.

17. The in-sink dishwasher according to claim 13, further comprising a plug seat located near a junction of a sump on the first drain and a waste drain conduit.

18. The in-sink dishwasher according to claim 13, further comprising an in-line heater positioned in the recirculation conduit for heating wash liquid passing through the recirculation conduit.

19. The in-sink dishwasher according to claim 18 wherein the in-line heater is positioned between the first drain and the liquid sprayer in the recirculation loop.

20. The in-sink dishwasher according to claim 13, further comprising a recirculation pump for pumping wash liquid through the recirculation conduit and into the liquid sprayer and a drain pump for pumping wash liquid from the recirculation conduit to the recirculation drain for allowing liquid to be drained from the wash chamber when the plug is seated in the first drain and the first drain is closed.

21. The in-sink dishwasher according to claim 13, wherein the bottom wall of the sink comprises first and second spaced apertures; the first aperture for accommodating the first drain for allowing wash liquid to flow out of the wash chamber and the second aperture for accommodating the liquid sprayer for allowing liquid to be re-introduced into the wash chamber.

22. The in-sink dishwasher according to claim 21, wherein the first aperture being positioned off-center in the bottom wall of the sink bowl and the second aperture being centrally positioned in the bottom wall of the sink bowl.

23. An in-sink dishwasher comprising:

a sink having a bowl comprising a bottom wall from which extends a peripheral side wall, which collectively define a wash chamber with an open top for receiving dishes to be washed;

a first drain fluidly connected to the wash chamber for draining wash liquid from the wash chamber;

a liquid sprayer fluidly connected to the wash chamber for introducing wash liquid to the wash chamber;

a recirculation conduit coupled between the first drain and the liquid sprayer for forming a liquid recirculation loop between the wash chamber, the first drain and the liquid sprayer;

a recirculation pump for pumping wash liquid through the recirculation conduit and into the liquid sprayer; and a drain pump in fluid communication with a recirculation drain and a waste drain conduit for pumping wash liquid from the recirculation loop to the waste drain conduit for allowing liquid to be drained from the wash chamber when a plug is seated in the first drain and the first drain is closed.

24. The in-sink dishwasher according to claim 23, wherein the plug is removably mounted in the first drain for fluidly closing the first drain but not restricting a flow of liquid in the recirculation loop when the first drain is closed by the plug.

25. The in-sink dishwasher according to claim 23, wherein the bottom wall of the sink comprises first and second spaced apertures; the first aperture for accommodating the first drain for allowing wash liquid to flow out of the wash chamber and the second aperture for accommodating the liquid sprayer for allowing liquid to be re-introduced into the wash chamber.

26. The in-sink dishwasher according to claim 25, wherein the first aperture being positioned off-center in the bottom wall of the sink bowl and the second aperture being centrally positioned in the bottom wall of the sink bowl.

27. The in-sink dishwasher according to claim 23, further comprising a sensor positioned within the first drain at a location above a plug seat positioned near a junction of a sump on the first drain and the waste drain conduit, wherein the plug rests against the plug seat when the plug closes the first drain.

28. The in-sink dishwasher according to claim 27 wherein the sensor is one of a temperature sensor and liquid level sensor.

29. The in-sink dishwasher according to claim 23 wherein the first drain comprises a sump and a sensor located in the sump.

30. The in-sink dishwasher according to claim 23, further comprising an in-line heater positioned in the recirculation conduit for heating wash liquid passing through the recirculation conduit.

31. The in-sink dishwasher according to claim 30 wherein the in-line heater is positioned between the first drain and the liquid sprayer in the recirculation loop.

32. The in-sink dishwasher according to claim 23, further comprising a recirculation drain conduit having an inlet fluidly connected to the recirculation conduit and an outlet fluidly connected to the waste drain conduit at a location spaced from the first drain, thereby permitting draining of the liquid from the recirculation conduit when the plug is received within the first drain.

* * * * *